US008251502B2

(12) United States Patent
Koseki

(10) Patent No.: US 8,251,502 B2
(45) Date of Patent: Aug. 28, 2012

(54) LIQUID-JET HEAD CHIP, LIQUID-JET HEAD, AND LIQUID-JET RECORDING APPARATUS

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 215 days.

(21) Appl. No.: 12/592,868

(22) Filed: Dec. 3, 2009

(65) Prior Publication Data

US 2010/0141711 A1 Jun. 10, 2010

(30) Foreign Application Priority Data

Dec. 8, 2008 (JP) ..... 2008-312367

(51) Int. Cl.
*B41J 2/175* (2006.01)
*B41J 2/045* (2006.01)

(52) U.S. Cl. ..... 347/93; 347/68; 347/69

(58) Field of Classification Search ..... 347/68–72, 347/93
See application file for complete search history.

(56) References Cited

U.S. PATENT DOCUMENTS 7,431,428 B2 * 10/2008 Yamada ..... 347/49
2002/0063766 A1 5/2002 Yoshizawa et al. ..... 347/100
2005/0206686 A1 9/2005 Hirano ..... 347/68

FOREIGN PATENT DOCUMENTS

EP 1122560 8/2001

* cited by examiner

*Primary Examiner* — Geoffrey Mruk
(74) *Attorney, Agent, or Firm* — Adams & Wilks

(57) ABSTRACT

A liquid-jet head chip includes an actuator substrate having liquid discharge flow paths for discharging a liquid and disposed parallel to and at a distance from each other. Each of the liquid discharge flow paths is open on a surface of the actuator substrate. A cover plate substrate is bonded onto the surface of the actuator substrate and has an opening portion that opens on a surface of the cover plate substrate on a side opposite to the actuator substrate. The opening portion includes a concave portion and through-holes extending from the concave portion and communicating with the liquid discharge flow paths. A filter structure is disposed at an approximately constant distance from the surface of the cover plate substrate to which the actuator substrate is bonded. The filter structure is located at a position so as to substantially close the opening portion of the cover plate substrate.

19 Claims, 5 Drawing Sheets

A relation between the nozzle number and the discharge speed as a reference example

LIQUID-JET HEAD CHIP, LIQUID-JET HEAD, AND LIQUID-JET RECORDING APPARATUS

BACKGROUND OF THE INVENTION

1. Field of the Invention

The present invention relates to a liquid-jet head chip, a liquid-jet head, and a liquid-jet recording apparatus.

2. Description of the Related Art

There is conventionally known a liquid-jet recording apparatus which uses a liquid-jet head having a plurality of discharge nozzles for discharging a liquid such as an ink therefrom to record characters or images on a recording medium. For example, an ink-jet head includes an actuator substrate, a cover plate substrate, and a flow path member for an ink. The actuator substrate includes a plurality of discharge grooves. The cover plate substrate forms an ink path. By applying a voltage to side walls of each of the discharge grooves, the side walls are subjected to shear deformation. In this manner, ink is discharged from a discharge nozzle.

In the ink-jet head as described above, each of discharge channels formed by the discharge grooves is provided with an independent structure so as to prevent the occurrence of conduction and short-circuit through electrodes in contact with an ink when a water-based ink is used as the ink. Moreover, a predetermined structure is sometimes provided in a common ink chamber constituted by the cover plate substrate and the flow path member (for example, see JP 2007-190756 A; hereinafter, referred to as "Patent Document 1").

An ink-jet head chip described in Patent Document 1 is provided with a filter for removing dust and the like present in the ink to be supplied to the discharge grooves. Such a structure is generally provided at an arbitrary position inside the common ink chamber and is located at a distance of 2 mm or larger from a surface of the actuator substrate, for example.

However, if the structure is located at the arbitrary position inside the common ink chamber as in the case of the conventional ink-jet head chip, crosstalk (propagation of a fluctuation in pressure to the other discharge channels) occurs between the neighboring discharge channels to affect discharge characteristics in some cases when the side walls of each of the discharge channels are subjected to shear deformation by applying the voltage to the side walls. More specifically, a discharge speed in some of the discharge channels is lowered. As a result, there is a problem in that the ink cannot be discharged at a desired discharge speed in some cases.

SUMMARY OF THE INVENTION

The present invention has been made in view of the above-mentioned circumstances, and has an object of providing a liquid-jet head chip, a liquid-jet head, and a liquid-jet recording apparatus, which are capable of discharging a liquid from each of liquid discharge flow paths without being affected by an operating state of the other liquid discharge flow paths.

In order to achieve the above-mentioned object, the present invention provides the following techniques.

The present invention provides a liquid-jet head chip including:

an actuator substrate including a plurality of liquid discharge flow paths, the plurality of liquid discharge flow paths each being open on one surface of the actuator substrate, the plurality of liquid discharge flow paths being formed in parallel at a distance from each other;

a cover plate substrate which is bonded onto the one surface of the actuator substrate, and includes an opening portion being open on a surface of the cover plate substrate on a side opposite to the actuator substrate and being in communication with the liquid discharge flow paths; and a structure having a flat surface at an approximately constant distance from a surface of the cover plate substrate, to which the actuator substrate is bonded, the structure being located at a position at which the opening portion of the cover plate substrate is substantially closed.

According to the present invention, when a liquid is stored in the opening portion provided to the cover plate substrate, the opening portion functions as a common liquid chamber for supplying the liquid to each of the liquid discharge flow paths. Moreover, side walls of each of the liquid discharge flow paths are subjected to shear deformation to change a volume of each of the liquid discharge flow paths. As a result, the liquid distributed from the opening portion to the liquid discharge flow paths can be discharged from each of the liquid discharge flow paths.

In this case, the structure having the flat surface at an approximately constant distance from a surface of the cover plate substrate, to which the actuator substrate are bonded, is located at a position at which the opening portion is substantially closed. As a result, even when the side walls are subjected to shear deformation by a piezoelectric method, the propagation of a fluctuation in pressure (so-called crosstalk), which may otherwise occur between some of the adjacent liquid discharge flow paths, can be suppressed. As a result, the liquid can be discharged from all the liquid discharge flow paths without being affected by the operation of the other liquid discharge flow paths.

In the above-mentioned invention, the opening portion may include: a concave portion having an aperture plane on the surface on the side opposite to the actuator substrate; and a plurality of through-holes extending from the concave portion to the liquid discharge flow paths.

With the configuration as described above, the liquid supplied from the aperture plane of the concave portion passes through the through-holes to be distributed to the liquid discharge flow paths. Therefore, for example, by arranging one through-hole for every two liquid discharge flow paths, the liquid-jet head chip for water-based ink can be configured.

Further, in the above-mentioned invention, the structure may be a foreign substance removal member.

With the configuration as described above, the foreign substance removal member is capable of, for example, removing dirt and dust contained in the liquid to be supplied to each of the liquid discharge flow paths and preventing large air bubbles from entering the liquid discharge flow paths. As an example of the foreign substance removal member, for example, a filter, a plate including a through-hole or the like is given.

Further, in the above-mentioned invention, the structure may be located at a distance less than 0.8 mm from the surface of the cover plate substrate, to which the actuator substrate is bonded.

With the configuration as described above, the occurrence of crosstalk is effectively prevented to further stabilize discharge characteristics of all the plurality of liquid discharge flow paths.

The present invention provides a liquid-jet head including: the liquid-jet head chip according to the present invention described above; and a flow path member bonded onto the one surface of the cover plate substrate, the flow path member including a flow path for supplying a liquid to the opening portion.

The present invention provides a liquid-jet recording apparatus including the liquid-jet head according to the present invention described above.

According to the present invention, the liquid is supplied from the flow path member to the liquid-jet head chip. Then, the liquid can be discharged from each of the liquid discharge flow paths without being affected by the operating state of the other liquid discharge flow paths. For example, when an ink is used as the liquid, the quality of printing on a recording medium can be improved.

According to the present invention, the effects of discharging the liquid from each of the liquid discharge flow paths without being affected by the operating state of the other liquid discharge flow paths can be obtained.

DETAILED DESCRIPTION OF THE PREFERRED EMBODIMENTS

Hereinafter, a liquid-jet head chip 1, a liquid-jet head 10, and a liquid-jet recording apparatus 100 according to an embodiment of the present invention are described referring to the accompanying drawings.

Figure 1:
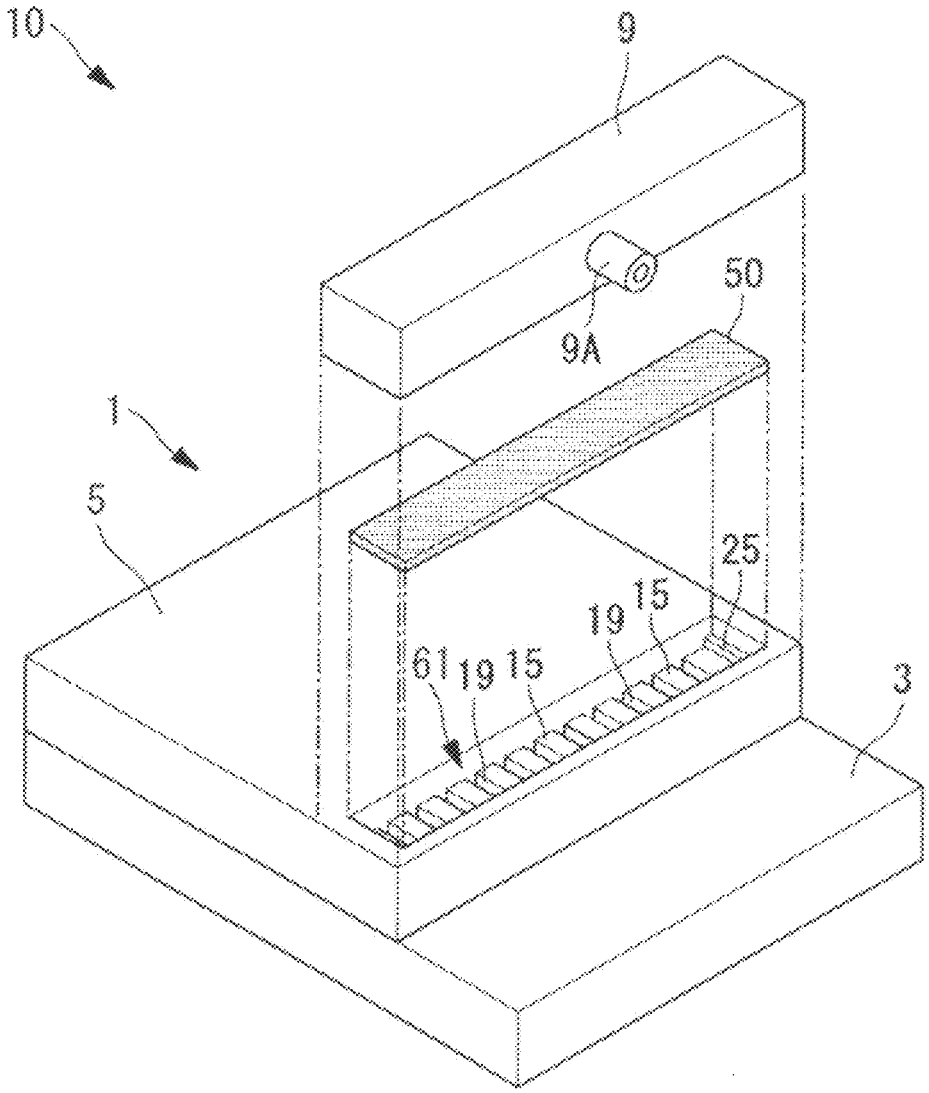
FIG. 1 is an exploded perspective view of a liquid-jet head according to an embodiment of the present invention.
Figure 2:
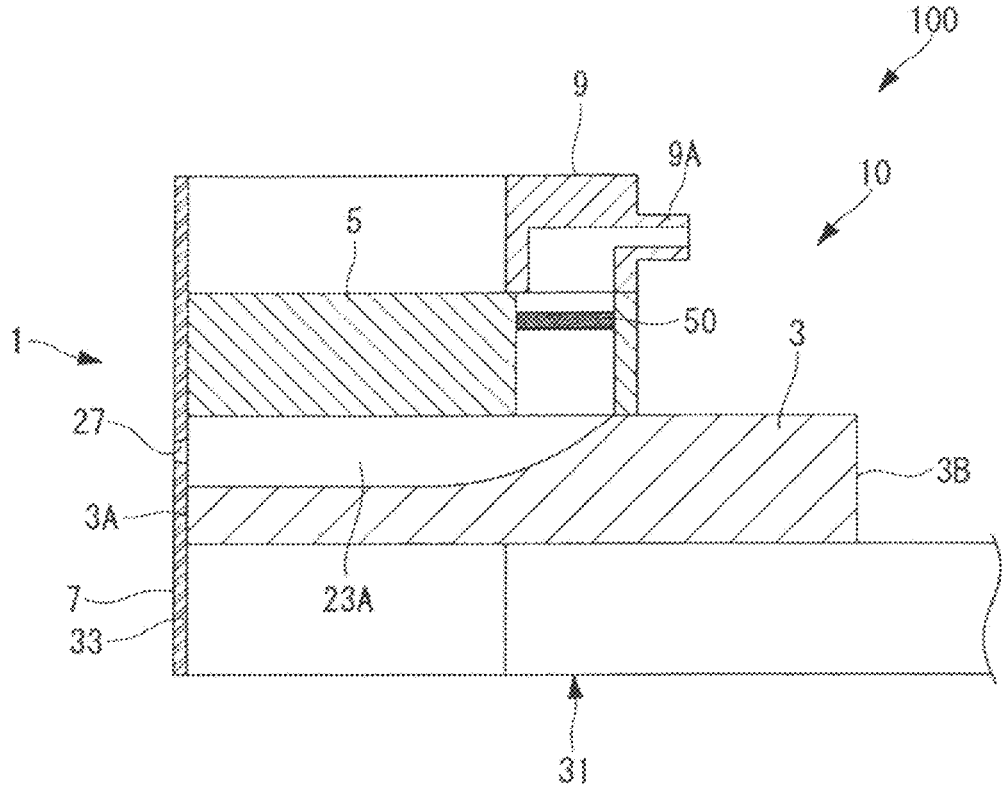
FIG. 2 is a longitudinal sectional view of the liquid-jet head illustrated in FIG. 1.
Figure 3:
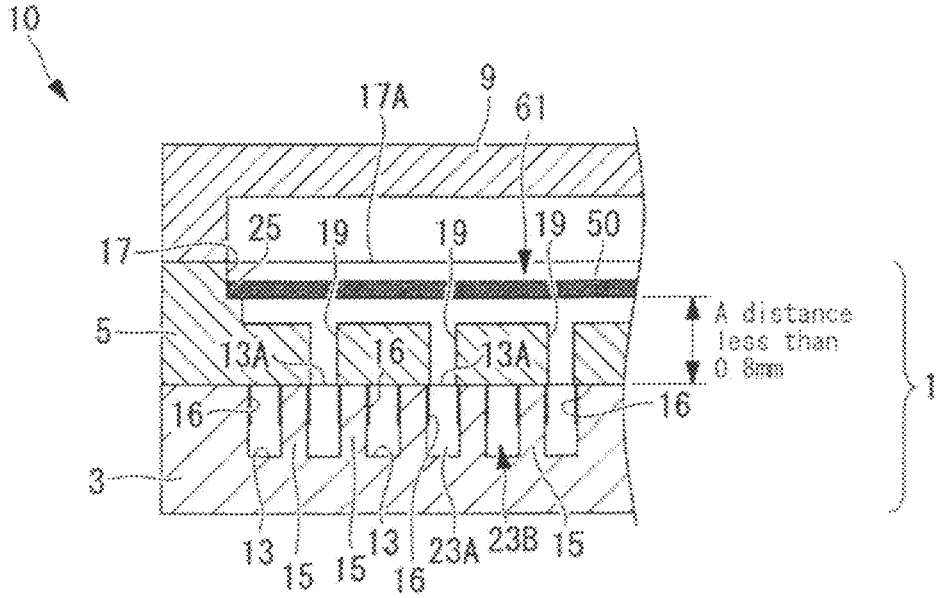
FIG. 3 is an enlarged sectional view of a liquid-jet head chip illustrated in FIG. 1.

The liquid-jet head 10 according to this embodiment discharges, for example, a water-based ink (liquid). As illustrated in FIGS. 1 to 3, the liquid-jet head 10 includes a liquid-jet head chip 1, a flow path (flow path member) 9 for supplying the ink to the liquid-jet head chip 1, and a wiring board (not shown) on which a drive circuit for driving the liquid-jet head chip 1 and the like is mounted. Each of the members described above is fixed onto a support plate 31 made of, for example, aluminum. The members are connected to each other through an adhesive, a double-faced adhesive tape, or the like, which has good thermal conductivity.

The liquid-jet head chip 1 includes a substantially-rectangular actuator substrate 3, a cover plate substrate 5, and a nozzle plate 7. The actuator substrate 3 having a thickness of about 0.8 mm is constituted by a piezoelectric element made of lead zirconate titanate (PZT) or the like. The cover plate substrate 5 having a thickness of about 0.8 mm is bonded onto one of the surfaces of the actuator substrate 3. The nozzle plate 7 is bonded onto an end surface of the actuator substrate 3 and an end surface of the cover plate substrate 5.

The actuator substrate 3 is polarized in a thickness direction. A plurality of discharge grooves (liquid discharge flow paths) 13, each having an opening portion 13A in one of the surfaces of the actuator substrate 3 on which the cover plate substrate 5 is provided, are arranged in parallel at a distance from each other. Each of the discharge grooves 13 has a depth of, for example, about 0.36 mm. The discharge grooves 13 are separated from each other by side walls 15.

One longitudinal end of each of the discharge grooves 13 extends to one end surface 3A of the actuator substrate 3, whereas each of the discharge grooves 13 starts gradually decreasing its depth in the middle to have a reduced depth at the other longitudinal end. Each of such discharge grooves 13 is shaped according to, for example, an outer diameter of a blade of a disc-like die cutter (not shown).

Moreover, electrodes 16 for applying a driving voltage are formed by vapor deposition on both the side walls 15 of each of the discharge grooves 13 to extend in a longitudinal direction of the actuator substrate 3. The electrodes 16 are formed from the opening portion 13A of each of the discharge grooves 13 to the middle in a depth direction of the discharge groove 13.

The cover plate substrate 5 is bonded onto one surface of the actuator substrate 3, that is, onto the surface of the actuator substrate 3, on which the opening portions 13A of the discharge grooves 13 are formed. The cover plate substrate 5 includes a cover plate opening portion (opening portion) 61 constituted by a concave-shaped common ink chamber (concave portion) 17 and a plurality of slits (through-holes) 19. The common ink chamber (concave portion) 17 has an aperture plane 17A on a surface of the cover plate substrate 5, which is on the side opposite to the actuator substrate 3. The plurality of slits 19 extend from the common ink chamber 17 to be brought into communication with the ends of some of the discharge grooves 13 of the actuator substrate 3, each having the reduced depth.

In a state where the cover plate substrate 5 is bonded onto the actuator substrate 3, the opening portions 13A of the discharge grooves 13 are closed by the cover plate substrate 5, thereby forming a plurality of independent discharge channels 23A and dummy channels 23B.

Each of the discharge channels 23A is an ink flow path constituted by the discharge groove 13 which is in communication with the slit 19 of the cover plate substrate 5. Each of the discharge channels 23A is filled with an ink supplied from the common ink chamber 17. Meanwhile, each of the dummy channels 23B is a cavity portion formed by closing the opening portion 13A of the discharge groove 13 with the cover plate substrate 5 and is sealed to prevent the ink from flowing thereinto. The discharge channels 23A and the dummy channels 23B are alternately formed in the direction in which the discharge grooves 13 are arranged.

The common ink chamber 17 is provided with step portions 25. Each of the step portions 25 is formed by inwardly projecting an inner wall surface in a direction away from the opening portion 61. Each of the step portions 25 is formed at a distance of about 0.5 mm from the surface of the cover plate substrate 5, which is on the side of the actuator substrate 3. A filter 50 (structure, foreign substance removal member) having a flat surface is fixed to the step portions 25 by bonding while being located to substantially close the aperture plane 17A of the common ink chamber 17.

The filter 50 has a thickness of about 0.1 mm and is located at an approximately constant distance, that is, at about 0.5 mm from ends of all the slits 19, which are on the actuator substrate 3 side. The filter 50 is capable of removing dirt and dust contained in the ink supplied from the common ink chamber 17 to the discharge grooves 13 and preventing large air bubbles from entering the discharge grooves 13. Moreover, even if the liquid-jet head chip 1 alone is handled separately at the time of assembly of the liquid-jet head 10 or the like, the dust or the like can be prevented from entering the common ink chamber 17.

The nozzle plate 7 is bonded to the end surface 3A of the actuator substrate 3, on which the discharge channels 23A and the dummy channels 23B are open. The nozzle plate 7 has nozzle holes 27 located to be opposed only to the openings of the discharge channels 23A. The openings of the dummy channels 23B are sealed by the nozzle plate 7. The nozzle plate 7 is, for example, a polyimide film through which the nozzle holes 27 are formed by using an excimer laser device or the like. A water-repellent film (not shown) having water repellency is formed on a surface of the nozzle plate 7, which is to be opposed to the recording medium, thereby preventing the ink from adhering thereto.

The flow path 9 is bonded to cover the aperture plane 17A of the cover plate substrate 5 and includes a connection portion 9A connected to a pressure-regulating chamber (not shown) for temporarily storing the ink fed from an ink tank (not shown).

The support plate 31 supports the actuator substrate 3 and the cover plate substrate 5 which are overlapped with each other and also supports the nozzle plate 7. A fit hole 33 extending in the direction in which the discharge grooves 13 are arranged is formed through the support plate. The support plate 31 supports the actuator substrate 3 and the cover plate substrate 5 which are overlapped with each other while the actuator substrate 3 and the cover plate substrate 5 are being fitted into the fit hole 33. A surface of the support plate 31 on the distal end side is flush with an end surface of each of the actuator substrate 3 and the cover plate substrate 5 on the distal end side.

Figure 4:
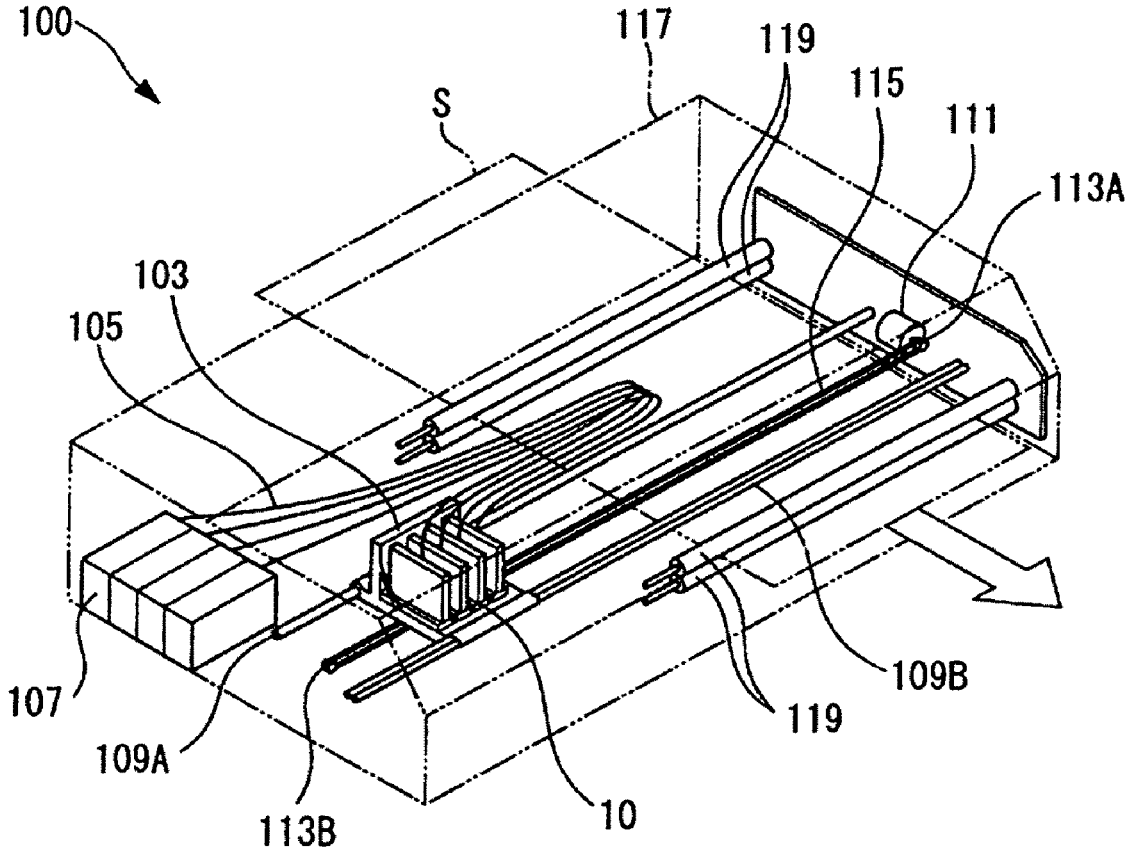
FIG. 4 is a schematic perspective view of a liquid-jet recording apparatus on which the liquid-jet head illustrated in FIG. 1 is mounted.

During use, the liquid-jet head 10 thus configured is mounted on the liquid-jet recording apparatus 100 which is an ink-jet recording apparatus used in a printer, a fax, or the like, as illustrated in FIG. 4.

The liquid-jet recording apparatus 100 includes a plurality of the liquid-jet heads 10, a carriage 103, and an ink cartridge 107. The plurality of liquid-jet heads 10 are respectively provided for different colors. The liquid-jet heads 10 are arranged in a main-scanning direction to be mounted onto the carriage 103. The ink cartridge 107 supplies the ink to the liquid-jet heads 10 through an ink supply tube 105 made of a flexible tube.

The carriage 103 is mounted to be movable in a long axis direction of a pair of guide rails 109A and 109B. A drive motor 111 is provided on the side of one end of the pair of the guide rails 109A and 109B. A drive force generated by the drive motor 111 is transmitted to a timing belt 115 bridged between a pulley 113A connected to the drive motor 111 and a pulley 113B provided on the side of the other end of the pair of the guide rails 109A and 109B. As a result, the carriage 103 fixed at a predetermined position on the timing belt 115 is conveyed.

A pair of conveying rollers 119 are provided along the guide rails 109A and 109B on the side of each end of a case 117 indicated by a dot line in a direction perpendicular to the direction in which the carriage 103 is conveyed. The pairs of conveying rollers 119 convey a recording medium S below the carriage 103 in a direction perpendicular to the direction in which the carriage 103 is conveyed.

In the liquid-jet recording apparatus 100 thus configured, the carriage 103 is scanned in a direction perpendicular to a direction in which the recording medium S is fed while the recording medium S is being fed by the conveying rollers 119. As a result, characters, images, and the like are recorded on the recording medium S by the liquid-jet heads 10.

Hereinafter, the functions of the liquid-jet heads 10 mounted on the liquid-jet recording apparatus 100 are specifically described.

After the ink supplied from the ink tank is temporarily stored in the pressure-regulating chamber, the ink passes through the connection portion 9A to be introduced into the flow path 9. Then, the ink is guided into the common ink chamber 17 of the cover plate substrate 5. Then, the ink is supplied from the common ink chamber 17 to all the discharge channels 23A in a distributed manner.

When a voltage is applied to the electrodes 16 on the both side walls 15 of a predetermined one of the discharge channels 23A, the side walls 15 are subjected to shear deformation due to a piezoelectric thickness-shear effect to change a volume of the corresponding discharge channel 23A. For example, the voltage is applied in one direction perpendicular to a polarization direction so as to outwardly deform both the side walls 15 of the discharge channel 23A, that is, to deform both the side walls 15 toward the dummy channel 23B. As a result, the amount of ink, which corresponds to an increase in volume of the discharge channel 23A, is introduced into the discharge channel 23A.

Next, the voltage applied to the side walls 15 is set to zero. Specifically, both the side walls 15 of the discharge channel 23A are placed in a state without deformation before the application of the voltage. As a result, the volume of the discharge channel 23A is reduced to increase the pressure, thereby discharging the ink from each of the nozzle holes 27.

In this case, the filter 50 having the flat surface at a distance less than 0.8 mm (specifically, at a distance of about 0.5 mm) from all the slits 19 is located at a position at which the aperture plane 17A of the common ink chamber 17 is substantially closed. Therefore, the propagation of a fluctuation in pressure (so-called crosstalk) between apart of the discharge channels 23A and the dummy channels 23B which are adjacent to each other can be efficiently suppressed.

Figure 5:
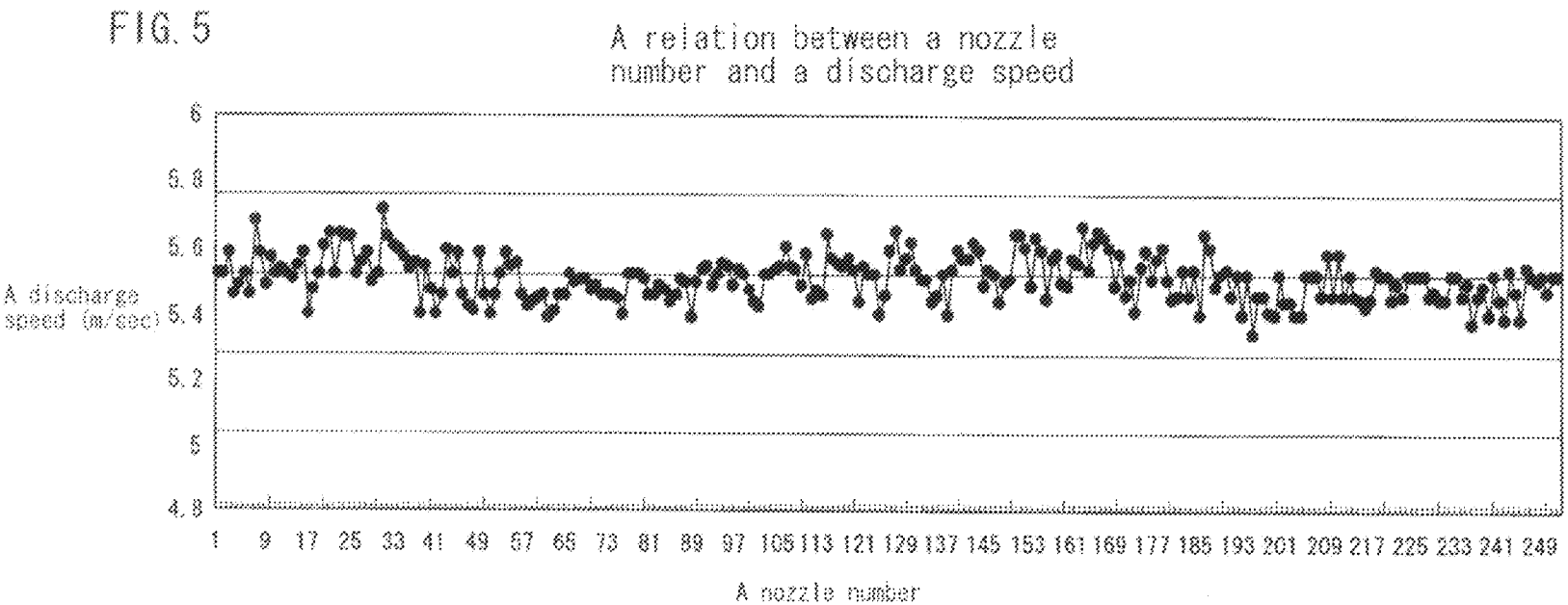
FIG. 5 is a graph showing a relation between a nozzle number and a discharge speed in the liquid-jet recording apparatus on which the liquid-jet head illustrated in FIG. 1 is mounted.

As a result, as shown in FIG. 5, discharge characteristics of all the discharge channels 23A can be substantially stabilized. Thus, the ink can be discharged from all the discharge channels 23A without being affected by an operating state of the dummy channels 23B adjacent thereto. More specifically, a difference in discharge speed from each of the discharge nozzles 27 can be kept to 0.2 m/s or less, whereas a difference in amount of discharged ink can be kept within ±3%. In FIG. 5, an ordinate axis represents the discharge speed (m/sec), whereas an abscissa axis represents a discharge nozzle hole number. As discharge conditions, a water-based dye ink is used as the ink, and the ink is discharged from all the nozzle holes 27 at a discharge frequency of 18 kHz.

For example, the discharge speed of the ink discharged from the discharge nozzle hole 27 of each of the discharge channels 23A is made substantially equal for all the discharge nozzle holes 27. As a result, the occurrence of unevenness in density of characters, images, and the like on the recording medium S can be prevented.

Here, as a comparative example of the liquid-jet head chip 1, the liquid-jet head 10, and the liquid-jet recording apparatus 100 according to this embodiment, for example, the case where the filter 50 is located at a distance of about 2 mm from the ends of all the slits 19 on the actuator substrate 3 side is described.

Figure 6:
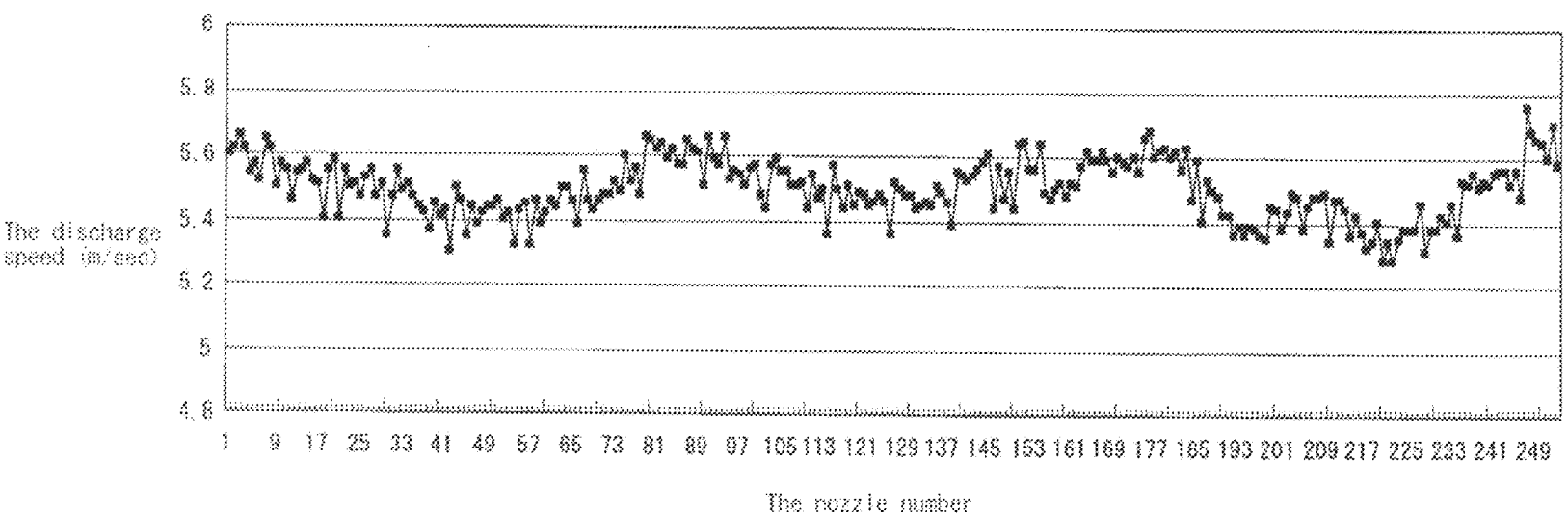
FIG. 6 is a graph showing a relation between the nozzle number and the discharge speed as a reference example of the embodiment of the present invention.

In this case, as shown in FIG. 6, the discharge speed varies periodically in the direction in which the discharge nozzles are arranged. Referring to FIG. 6, the discharge speed is large for nozzles Nos. 1 to 9 and 81 to 97, in the vicinity of a nozzle No. 177, and in the vicinity of a nozzle No. 249, whereas the discharge speed is small in the vicinity of a nozzle No. 41, in the vicinity of a nozzle No. 129, and for nozzles Nos. 217 to 233. As described above, with the configuration of this comparative example, the discharge characteristics of all the discharge channels 23A cannot be stabilized.

Moreover, although the filter 50 has been exemplified for description in this embodiment, any structure having a flat surface, which can be located at an approximately constant distance from the ends of all the slits 19, may be used instead. For example, a plate having a through-hole may be used. In this case, it is preferred to locate the structure at a distance less than 0.8 mm from the ends of all the slits 19.

Further, the discharge channels 23A and the dummy channels 23B are alternately formed in the direction in which the discharge grooves 13 are arranged in this embodiment. Instead, however, the slits 19 of the cover plate substrate 5 may be brought into communication with all the discharge grooves 13 to form only the discharge channels 23A. In this case, the nozzle holes 27 may be formed through the nozzle plate 7 at intervals so as to be opposed to all the discharge channels 23A. In this manner, the ink can be discharged from each of all the discharge grooves 13 (in other words, all discharge channels 23A) without being affected by the operation of the other discharge grooves 13 (other discharge channels 23A).

Further, in this embodiment, there has been described a driving method for setting the voltage applied to the side walls 15 to zero to bring both of the side walls 15 of the discharge channel 23A into an undeformed a state before the application of the voltage. However, the voltage may be applied in the opposite direction. Specifically, the voltage may be applied in the other direction perpendicular to the polarization direction to inwardly deform both the side walls 15 of the discharge channel 23A, that is, to deform both the side walls 15 away from the dummy channels 23B. In this manner, the volume of the discharge channel 23A is reduced to increase the pressure, whereby the ink is discharged from the nozzle holes 27.

The different driving method has also been described as above. In the above-mentioned methods, when the ink is required to be further pressurized to stably discharge the ink, the side walls 15 are deformed to project toward the discharge channels from which the ink is discharged. An internal pressure of the discharge channels, from which the ink is discharged, is further increased by this operation, and hence the ink can be further pressurized. However, the operation is performed for the purpose of stably discharging the ink as described above, and hence the operation is not essential. Therefore, the operation may be arbitrarily used as needed. Moreover, by performing the operations described above in combination as needed, the optimal discharge of the ink can be realized.

Further, although the ink-jet recording apparatus has been described as an example of the liquid-jet recording apparatus in this embodiment, the liquid-jet recording apparatus is not limited to the printer. For example, the liquid-jet recording apparatus of the present invention may include a fax, an on-demand printer, or the like. Moreover, although the plurality of nozzle holes 27 are linearly arranged in one row in the direction of arrangement, the plurality of nozzle holes 27 may be arranged to be shifted from each other in a longitudinal direction. For example, the plurality of nozzle holes 27 may be arranged obliquely or in a zigzag pattern. Moreover, the shape of each of the nozzle holes 27 is not limited to a circle. For example, the shape of each of the nozzle holes 27 may include an ellipsoid, a star-like shape or a polygon such as a triangle.

Although the case where the water-based ink is used has been described in this embodiment, a non-conductive oil-based ink, a solvent ink, a UV-ink, or the like may be used. When the oil-based ink is used, it is sufficient to provide the liquid-jet head chip 1 with the above-mentioned structure including the discharge channels 23A alone. Specifically, the slits 19 of the cover plate substrate 5 are brought into communication with all the discharge grooves 13 to form the discharge channels 23A alone. By thus configuring the liquid-jet head chip, any type of ink may be used. Therefore, the water-based ink can be used to perform recording. In particular, even the ink having conductivity can be used without any problems, and hence the added value of the ink-jet printer can be enhanced. For the rest, similar functions and effects can be obtained.

Although the cover plate opening portion 61 of the cover plate substrate 5 includes the common ink chamber 17 and the slits 19 in this embodiment, the cover plate opening portion 61 may be in communication with all the discharge grooves 13 without including the slits 19, for example. In this manner, for example, when the oil-based ink is used, the configuration of the liquid-jet head chip 1 can be simplified.

Moreover, although the common ink chamber 17 is formed in the cover plate substrate 5 in this embodiment, the common ink chamber may be formed in the actuator substrate 3 as a reference example. For example, the following structure may be alternatively used. In this alternative structure, the common ink chamber with a U-shaped cross section, extending in the direction in which the discharge grooves 13 are arranged, is formed on a rear surface of the actuator substrate 3 (on the surface of the actuator substrate 3, which is on the side opposite to the surface on which the discharge grooves 13 are formed). On a bottom surface of the common ink chamber, the slits in communication with the discharge grooves are formed. In this case, the position of the support plate 31 is changed. Specifically, the support plate 31 is arranged to be superimposed on the cover plate substrate 5.

What is claimed is:

1. A liquid-jet head chip comprising:

an actuator substrate comprising a plurality of liquid discharge flow paths for discharging a liquid and disposed parallel to and at a distance from each other, each of the liquid discharge flow paths being open on a surface of the actuator substrate;

a cover plate substrate bonded onto the surface of the actuator substrate and having an opening portion that opens on a surface of the cover plate substrate on a side opposite to the actuator substrate, the opening portion comprising a concave portion and a plurality of through-holes extending from the concave portion through the cover plate substrate and communicating with the liquid discharge flow paths; and a structure having a flat surface and being disposed at an approximately constant distance from the surface of the cover plate substrate to which the actuator substrate is bonded, the structure being located at a position at which the opening portion of the cover plate substrate is substantially closed by the structure.

2. A liquid-jet head chip according to claim 1; wherein the structure comprises a foreign substance removal member.

3. A liquid-jet head chip according to claim 2; wherein the structure is located at a distance less than 0.8 mm from the surface of the cover plate substrate to which the actuator substrate is bonded.

4. A liquid-jet head chip according to claim 1; wherein the structure is located at a distance less than 0.8 mm from the surface of the cover plate substrate to which the actuator substrate is bonded.

5. A liquid-jet head chip according to claim 4; wherein the structure comprises a foreign substance removal member.

6. A liquid-jet head, comprising:

the liquid-jet head chip according to claim 1; and a flow path member bonded onto the surface of the cover plate substrate, the flow path member having a flow path for supplying a liquid to the opening portion of the cover plate substrate.

7. A liquid-jet recording apparatus comprising the liquid-jet head according to claim 6.

8. A liquid-jet head chip according to claim 1; wherein the structure comprises a filter for filtering dirt and dust contained in a liquid supplied from the concave portion to the liquid discharge flow paths via the through-holes and for preventing air bubbles of preselected dimensions from entering the liquid discharge flow paths.

9. A liquid-jet head chip according to claim 8; wherein the concave portion comprises a plurality of step portions having surfaces supporting the filter.

10. A liquid-jet head chip according to claim 9; wherein the surfaces of the step portions support the filter against the flow of the supplied liquid so that the filter is pressed into contact with the surfaces of the step portions by the liquid flow.

11. A liquid-jet head chip according to claim 8; wherein the filter is adhered to the surfaces of the step portions by an adhesive.

12. A liquid-jet head chip according to claim 11; wherein the surfaces of the step portions support the filter against the flow of the supplied liquid so that the filter is pressed into contact with the surfaces of the step portions by the liquid flow and is firmly retained on the step portions irrespective of an adhesion strength of the adhesive.

13. A liquid-jet head chip according to claim 1; wherein the concave portion comprises a plurality of step portions having surfaces supporting the structure against the flow of liquid supplied from the concave portion to the liquid discharge flow paths via the through-holes.

14. A liquid-jet head chip according to claim 13; wherein the surfaces of the step portions support the structure against the flow of the supplied liquid so that the structure is pressed into contact with the surfaces of the step portions by the liquid flow.

15. A liquid-jet head chip comprising:

an actuator substrate comprising a plurality of liquid discharge flow paths for discharging a liquid;

a cover plate substrate bonded onto the surface of the actuator substrate, the cover plate substrate having a concave portion, a plurality of through-holes extending from the concave portion and communicating with the liquid discharge flow paths of the actuator substrate so that a liquid supplied to the concave portions flows to the liquid discharge flow paths via the through-holes, and a plurality of step portions formed in the concave portion and having surfaces opposing the flow of the supplied liquid; and a filter supported on the surfaces of the step portions of the cover plate substrate for filtering dirt and dust contained in the supplied liquid and for preventing air bubbles of preselected dimensions from entering the liquid discharge flow paths.

16. A liquid-jet head chip according to claim 15; wherein the liquid discharge flow paths are disposed parallel to and at a distance from each other; and wherein the filter is disposed at an approximately constant distance from the surface of the cover plate substrate to which the actuator substrate is bonded and is positioned so as to substantially close the concave portion of the cover plate substrate.

17. A liquid-jet head chip according to claim 16; wherein filter is disposed at a distance less than 0.8 mm from the surface of the cover plate substrate.

18. A liquid-jet head, comprising:

the liquid-jet head chip according to claim 15; and a flow path member bonded onto the surface of the cover plate substrate, the flow path member having a flow path for supplying ink to the concave portion of the cover plate substrate.

19. A liquid-jet recording apparatus comprising the liquid-jet head according to claim 18.

* * * * *